US009562482B2

(12) United States Patent
Takagi et al.

(10) Patent No.: US 9,562,482 B2
(45) Date of Patent: Feb. 7, 2017

(54) VEHICLE CONTROL APPARATUS

(75) Inventors: Masashi Takagi, Nagoya (JP); Motonari Ohbayashi, Nisshin (JP); Yuki Minase, Toyota (JP); Shinya Kodama, Toyota (JP); Toshihiro Takagi, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 450 days.

(21) Appl. No.: 14/125,783

(22) PCT Filed: Jul. 4, 2011

(86) PCT No.: PCT/JP2011/065269

§ 371 (c)(1),
(2), (4) Date: Dec. 12, 2013

(87) PCT Pub. No.: WO2013/005288

PCT Pub. Date: Jan. 10, 2013

(65) Prior Publication Data

US 2014/0107907 A1 Apr. 17, 2014

(51) Int. Cl.

| | |
|---|---|
| ***F02D 41/08*** | (2006.01) |
| ***F02D 11/10*** | (2006.01) |
| ***F02D 35/00*** | (2006.01) |

(52) U.S. Cl.

CPC ..... *F02D 35/00* (2013.01); *F02D 11/106* (2013.01); *F02D 11/107* (2013.01); *F02D 41/083* (2013.01)

(58) Field of Classification Search

CPC ..... F02D 11/107; F02D 11/106; F02D 35/00; F02D 35/0007; F02D 2250/18; F02D 2250/21; F02D 2250/24; F02D 2200/1006; F02D 41/083; F02D 41/22; F02D 2041/227; F02D 2009/0277; F02D 2009/0281; F02D 2009/0296; F02D 19/025; F02D 19/0623

(Continued)

(56) References Cited

U.S. PATENT DOCUMENTS

| | | | | |
|---|---|---|---|---|
| 4,898,005 A | | 2/1990 | Sakurai | |
| 5,027,609 A | * | 7/1991 | Yashiki | B60H 1/3208 123/198 R |

(Continued)

FOREIGN PATENT DOCUMENTS

| | | |
|---|---|---|
| DE | 10259486 A1 | 7/2004 |
| DE | 10344705 A1 | 4/2005 |

(Continued)

*Primary Examiner* — Lindsay Low
*Assistant Examiner* — George Jin
(74) *Attorney, Agent, or Firm* — Sughrue Mion, PLLC

(57) ABSTRACT

A vehicle is equipped with an auxiliary that is driven by the output of an internal combustion engine and which is capable of obtaining drive force by transmitting the output of the internal combustion engine to driving wheels. If an air conditioning compressor is being driven during engine idling of the internal combustion engine, an electronic control apparatus implements output-increase control for increasing the output of the internal combustion engine in comparison to when the air conditioning compressor is not being driven. If the force applied to the accelerator pedal (Pac) is equal to or more than a prescribed value (Pth), output-reduction control for reducing the output of the internal combustion engine by initiating engine idling of the internal combustion engine, and prohibiting the drive of the air conditioning compressor, is implemented.

2 Claims, 2 Drawing Sheets

(58) Field of Classification Search
USPC ..... 123/339.16, 339.17, 399, 370; 701/103, 701/110
See application file for complete search history.

(56) References Cited

U.S. PATENT DOCUMENTS

| | | | | |
|---|---|---|---|---|
| 6,086,510 | A * | 7/2000 | Kadota | F02D 11/105 477/107 |
| 2001/0041955 | A1* | 11/2001 | Nada | B60K 6/445 701/29.2 |
| 2005/0178357 | A1* | 8/2005 | Yui | F02D 13/02 123/339.16 |
| 2006/0046896 | A1* | 3/2006 | Nakajima | B60W 10/06 477/107 |
| 2007/0034440 | A1 | 2/2007 | Zomotor | |
| 2011/0196595 | A1* | 8/2011 | Cook | F02D 11/107 701/107 |

FOREIGN PATENT DOCUMENTS

| | | | |
|---|---|---|---|
| JP | 6-61551 | U | 8/1994 |
| JP | 2007-198278 | A | 8/2007 |
| JP | 2011-26966 | A | 2/2011 |

* cited by examiner

VEHICLE CONTROL APPARATUS

CROSS REFERENCE TO RELATED APPLICATIONS

This application is a National Stage of International Application No. PCT/JP2011/065269 filed Jul. 4, 2011, the contents of all of which are incorporated herein by reference in their entirety.

FIELD OF THE DISCLOSURE

The present invention relates to a control apparatus for a vehicle that obtains drive force by transmitting output of an internal combustion engine to the drive wheels.

BACKGROUND OF THE DISCLOSURE

An apparatus described in Patent Document 1, for example, is conventionally known as one such control apparatus for a vehicle. Generally, in conventional vehicles including those employing the technique of Patent Document 1, auxiliary devices such as a compressor for an air conditioner and an alternator are driven by the output of an internal combustion engine. If an auxiliary device is in operation when the output of the engine is low, such as when the engine is idling, the load caused by the auxiliary device is increased and operation of the engine is destabilized. To solve this problem, the conventional control apparatus performs output increasing control, or, in other words, idle-up control, to increase the output of the engine when the auxiliary device is operated. The output of the engine is thus increased when the auxiliary device is in operation compared to when the auxiliary device is not in operation. This restricts destabilization of the operation of the engine caused by the operating auxiliary device.

PRIOR ART DOCUMENT

Patent Document

Patent Document 1: Japanese Laid-Open Utility Model Publication No. 6-61551

SUMMARY OF THE INVENTION

Problems that the Invention is to Solve

If the accelerator, which is an accelerating operation section, is operated by force greater than or equal to a predetermined value while the vehicle is being backed, the control apparatus for a vehicle may execute output decreasing control to decrease the output of the internal combustion engine to, for example, a value corresponding to the idling state. The output decreasing control prevents the output of the engine from being increased by an amount corresponding to a rapid increase in the operation amount of the accelerator. This limits an abrupt increase in the drive force driving the vehicle.

However, if the output decreasing control, which is carried out in response to operation of the accelerator by the force greater than or equal to the predetermined value, is combined with the aforementioned output increasing control performed when an auxiliary device is operated, the vehicle may have the problem described below. Specifically, if an auxiliary device is operated when the internal combustion engine is idling, the output increasing control is carried out to limit destabilization of the engine operation caused by the operating auxiliary device. This raises the output of the engine compared to the value corresponding to the idling state, thus hampering desired decrease of the engine output. As a result, the decrease state of the engine output varies depending on the operating state of the auxiliary device. This correspondingly varies the drive force driving the vehicle, thus causing discomfort for the driver.

The above-described problem is not limited to the control apparatus that performs the idle-up control when an engine idles and decreases the output of the engine to the value corresponding to the idling state when the accelerator is operated by a force greater than or equal to a predetermined value. In other words, the problem occurs generally in common for techniques that employ the output increasing control to increase the output of an internal combustion engine when an auxiliary device is in operation compared to when the auxiliary device is not in operation and decrease the engine output in response to operation of an accelerator by force greater than or equal to a predetermined value.

Accordingly, it is an objective of the present invention to provide a control apparatus for a vehicle capable of decreasing the output of an internal combustion engine in a desired manner regardless of whether a request for operating an auxiliary device has been generated when an accelerator is depressed by force greater than or equal to a predetermined value.

Means for Solving the Problems

To achieve the foregoing objective, a control apparatus is provided that used in a vehicle that obtains a drive force by transmitting output of an internal combustion engine to a drive wheel and includes an auxiliary device operated by the output of the engine. The control apparatus performs output increasing control to increase the output of the engine when the auxiliary device is in operation compared to when the auxiliary device is not in operation. The control apparatus carries out output decreasing control to decrease the output of the engine and restrict operation of the auxiliary device when an accelerator is operated by a force greater than or equal to a predetermined value.

In this configuration, the output of the engine is raised when the auxiliary device is in operation compared to when the auxiliary device is not in operation. This limits destabilization of the engine operation caused by the auxiliary device in operation. When the accelerator is operated by force greater than or equal to the predetermined value, the output of the engine is decreased and operation of the auxiliary device is restricted. This reduces the load caused by the auxiliary device and thus limits increase of the engine output through the output increasing control. As a result, in response to the accelerator operated by the force greater than or equal to the predetermined value, the output of the engine is decreased in a desired manner regardless of whether a request for operating the auxiliary device has been generated.

In this case, the restriction on operation of the auxiliary device is preferably carried out to prohibit the operation of the auxiliary device.

In this configuration, when the accelerator is operated by force greater than or equal to the predetermined value, the output of the engine is reduced and operation of the auxiliary device is prohibited. This prevents generation of the load caused by the auxiliary device. In other words, in the configuration, the output increasing control for the engine, which is carried out in response to operation of the auxiliary device, is not carried out if the accelerator is operated by the force greater than or equal to the predetermined value. As a result, the output of the engine is reliably reduced when the accelerator is operated by the force greater than or equal to the predetermined value.

It is preferably determined that the accelerator has been operated by great force when an accelerator operating force is greater than or equal to a predetermined value.

In this configuration, it is reliably determined that the accelerator has been operated by great force based on the fact that the accelerator operating force is greater than or equal to the predetermined value.

It is preferably determined that the accelerator has been operated by great force when an accelerator operating acceleration is greater than or equal to a predetermined value.

In this configuration, it is reliably determined that the accelerator has been operated by great force based on the fact that the accelerator operating acceleration is greater than or equal to the predetermined value.

DETAILED DESCRIPTION OF THE PREFERRED EMBODIMENTS

An embodiment of a control apparatus for a vehicle according to the present invention will now be described in detail with reference to FIGS. 1 to 3.

Figure 1:
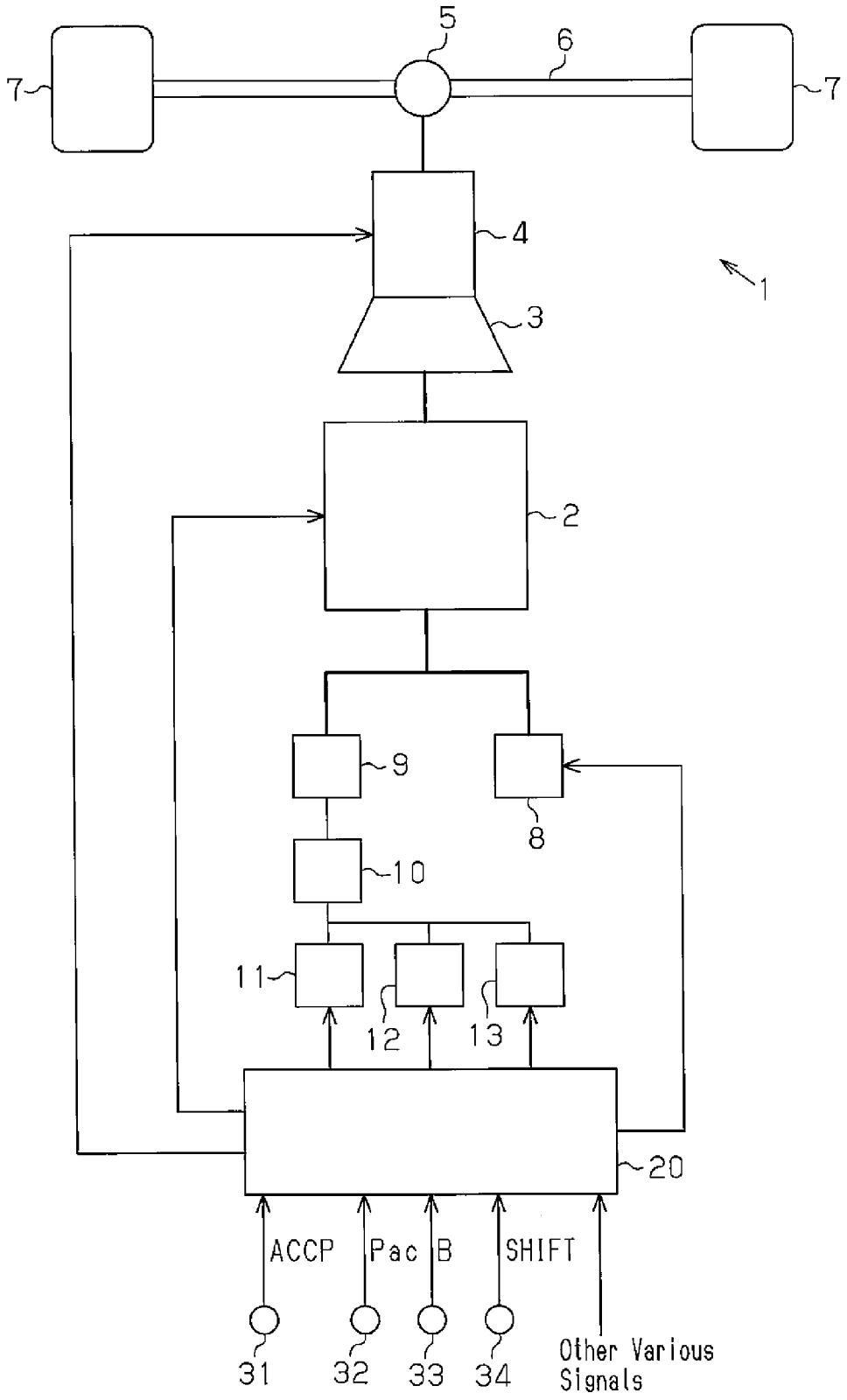
FIG. 1 is a diagram schematically representing one embodiment of a control apparatus for a vehicle according to the present invention, mainly illustrating the vehicle and an electronic control unit for controlling the vehicle.

As illustrated in FIG. 1, a vehicle 1 transmits the output of an internal combustion engine 2 to a torque converter 3, an automatic transmission 4, a differential device 5, and an axle 6 sequentially in this order. The output of the engine 2 is transmitted to drive wheels 7 eventually as drive force.

The vehicle 1 includes auxiliary devices driven by the output of the engine 2. The auxiliary devices include, for example, an air-conditioner compressor 8, which is a component of an air conditioner, an alternator 9, and a water pump (not shown). The auxiliary devices are connected to the crankshaft, which is the output shaft of the engine 2, through a belt or a chain.

The electric power produced by the alternator 9 is charged in a battery 10. The power is then supplied from the battery 10 to activate a blower fan 11, which is a component of the air conditioner for the passenger compartment, a seat heater 12 for heating a seat for a passenger, and an audio device 13.

A switch for the air conditioner, a switch for the seat heater 12, and a switch for the audio device 13 are arranged in the passenger compartment. Each one of the switches is turned on by the driver to generate a request for operating the corresponding one of the auxiliary devices. A power generating request for the alternator 9 is also generated based on the charging state of the battery 10 or operating states of electric devices.

An electronic control unit 20 carries out various types of control for the vehicle 1, which include various types of control performed on the engine 2 and various types of control executed on the auxiliary devices.

The engine 2 includes various types of sensors for detecting the engine operating states including the engine speed NE, the air intake amount, the throttle opening degree, and the coolant temperature, in addition to an ignition switch. The vehicle 1 includes an accelerator operation amount sensor 31 for detecting the accelerator operation amount ACCP corresponding to the depression amount of the accelerator pedal and a pressure sensor 32 for detecting the depressing force Pac applied to the accelerator pedal. There are also a brake sensor 33 for detecting the brake operation amount B corresponding to the depression amount of the brake pedal, a shift position sensor 34 for detecting the position of the shift lever (hereinafter, the shift position) for switching modes of the automatic transmission 4, and a vehicle speed sensor (not shown) for detecting the vehicle speed V. These sensors are electrically connected to the electronic control unit 20.

The electronic control unit 20 has a central processing unit (a CPU) for performing calculations related to various types of control, a read-only memory (a ROM) storing programs and data for various types of control, and a random-access memory (a RAM) for temporarily storing calculation results. The electronic control unit 20 reads detection signals from the aforementioned sensors and carries out the calculations, thus controlling the vehicle 1 in an overall fashion based on the obtained results.

The electronic control unit 20 determines the required drive force for the vehicle 1 using the accelerator operation amount ACCP and controls the output of the engine 2 based on the required drive force and the vehicle speed V to control traveling of the vehicle 1.

For example, the electronic control unit 20 controls the engine 2 to idle when the accelerator operation amount ACCP is 0 and the required drive force for the vehicle 1 is 0. In other words, the output of the engine 2 is controlled to change the engine speed NE to the idling engine speed Nidle (for example, 800 rpm).

If an auxiliary device (for example, the air-conditioner compressor 8) is operated by the engine idling, increased load caused by the auxiliary device may destabilize the engine operation. To solve the problem, the electronic control unit 20 of the illustrated embodiment performs output increasing control, which is idle-up control, to increase the output of the engine 2 by the amount corresponding to the load caused by the auxiliary device if the auxiliary device, which is driven by the engine, is in operation. Specifically, the electronic control unit 20 carries out the idle-up control to increase the output of the engine 2 compared to when the auxiliary device is not in operation by raising the engine speed NE to a target engine speed Nup (for example, 1200 rpm), which is higher than the idling engine speed Nidle.

In the illustrated embodiment, output decreasing control is performed on the engine 2 in the manner described below. Specifically, when the accelerator pedal is operated by force greater than or equal to a predetermined value, the electronic control unit 20 carries out the output decreasing control to reduce the output of the engine 2 to the output corresponding to the idling state and prohibit operation of the air-conditioner compressor 8.

The procedure for carrying out the output decreasing control for the engine 2 will hereafter be described in detail with reference to FIG. 2. The sequence of procedure illustrated in FIG. 2 is repeatedly performed at predetermined time intervals when the engine 2 is in operation and the shift lever is at the reverse position.

Figure 2:
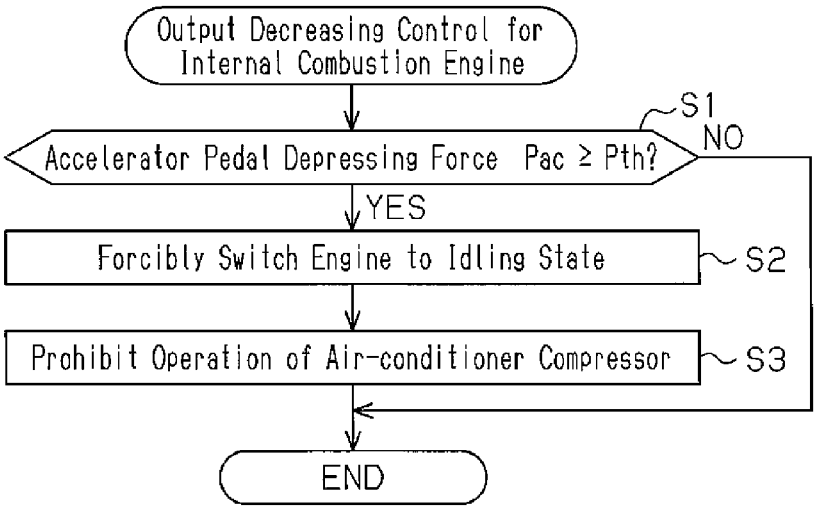
FIG. 2 is a flowchart representing a procedure for carrying out output decreasing control for an internal combustion engine according to the embodiment.

Referring to FIG. 2, in the procedure, the electronic control unit 20 first determines whether the depressing force Pac applied to the accelerator pedal, is greater than or equal to a predetermined value Pth in step S1. In other words, it is determined whether the accelerator pedal has been operated by the force greater than or equal to the predetermined value. Specifically, the value Pth is defined as the force applied to the accelerator pedal by the driver when the driver depresses the accelerator pedal inadvertently and set in advance through experimentation and simulations.

If the depressing force Pac applied to the accelerator pedal is less than the predetermined value Pth (step S1: NO), it is determined that execution of the output decreasing control is currently unnecessary and the procedure is suspended. In this case, the electronic control unit 20 carries out the output control of the engine 2 corresponding to the accelerator operation amount ACCP, which is normal engine output control.

In contrast, if the depressing force Pac applied to the accelerator pedal, is greater than or equal to the value Pth (step S1: YES), the electronic control unit 20 performs step S2 to forcibly switch the engine 2 to the idling state. The electronic control unit 20 then carries out step S3 to prohibit operation of the air-conditioner compressor 8. The procedure is then suspended.

The operation of the illustrated embodiment will now be described with reference to FIG. 3.

When the air-conditioner compressor 8 is in operation with the engine 2 idling, the electronic control unit 20 executes the output increasing control to increase the output of the engine 2 compared to when the air-conditioner compressor 8 is not in operation. This restricts destabilization of the engine operation caused by operation of the air-conditioner compressor 8.

Figure 3:
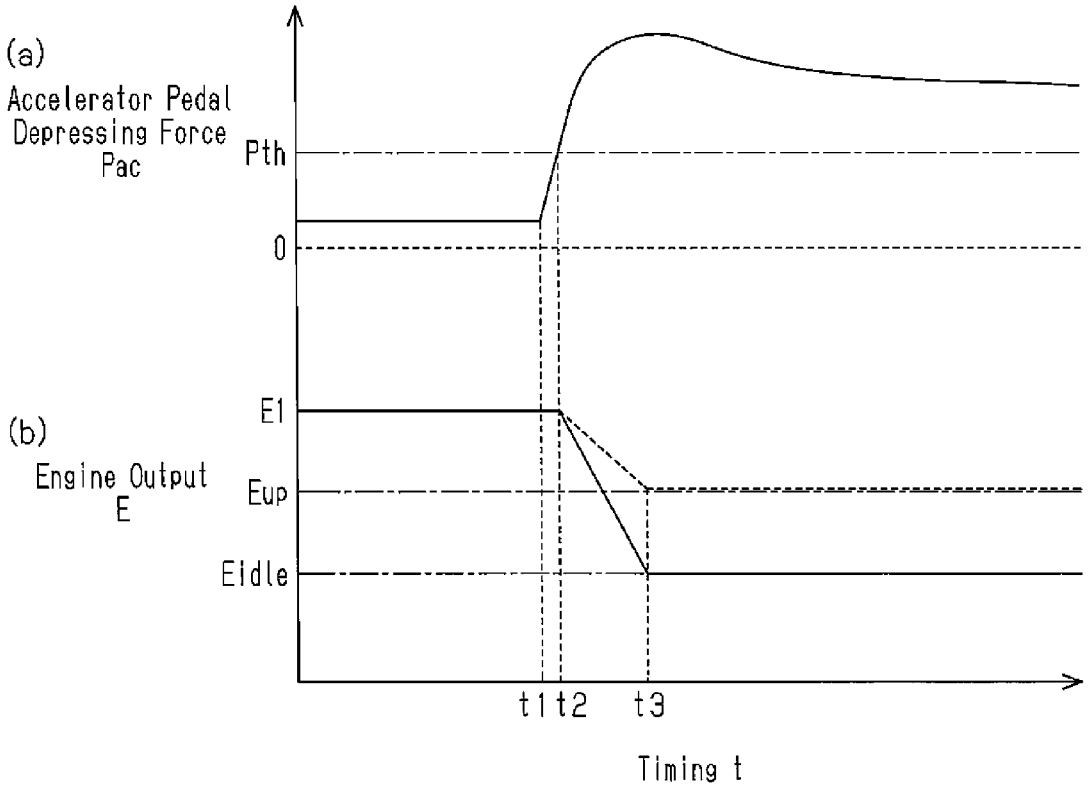
FIG. 3 is a timing chart illustrating the operation of the embodiment, with the accelerator depressing force represented in section (a) and an example of change of the engine output represented in section (b).

If the vehicle is being backed with the air-conditioner compressor 8 in operation and the depressing force Pac applied to the accelerator pedal is greater than or equal to the predetermined value Pth at the timing t2, the output E of the engine 2 is decreased from the output E1 as illustrated in section (b) of FIG. 3 as shown in section (a) of FIG. 3.

As represented by the corresponding broken line in section (b) of FIG. 3, if the output increasing control (the idle-up control) is carried out for an auxiliary device in operation, the output E of the engine 2 is reduced only to the output Eup, which is higher than the output Eidle in the idling state, at the time point t3.

However, in the illustrated embodiment, operation of the air-conditioner compressor 8 is prohibited by the electronic control unit 20 regardless of whether a request for operating the air-conditioner compressor 8 has been generated. The air-conditioner compressor 8 thus does not generate load. As a result, as represented by the corresponding solid line in section (b) of FIG. 3, the output increasing control (the idle-up control) is not carried out. The output E of the engine 2 is thus decreased to the output Eidle in the idling state at the time point t3.

The control apparatus for a vehicle of the illustrated embodiment, which has been described above, has the advantages described below.

(1) When the air-conditioner compressor 8 is operated with the engine 2 idling, the electronic control unit 20 performs the output increasing control to increase the output of the engine 2 compared to when the air-conditioner compressor 8 is not operated. Further, when the depressing force Pac applied to the accelerator pedal is greater than or equal to the predetermined value Pth, the electronic control unit 20 carries out the output decreasing control to decrease the output of the engine 2 by switching the engine 2 to the idling state and prohibit operation of the air-conditioner compressor 8.

As a result, when the accelerator pedal is depressed by force greater than or equal to the predetermined value, the output of the engine 2 is reliably decreased regardless of whether a request for operating the air-conditioner compressor 8 has been generated.

(2) When the depressing force Pac applied to the accelerator pedal is greater than or equal to the predetermined value Pth, the electronic control unit 20 determines that the accelerator has been operated by great force. As a result, it is reliably determined that the accelerator has been depressed with great force based on the fact that the depressing force Pac applied to the accelerator pedal is greater than or equal to the predetermined value Pth.

The control apparatus for a vehicle according to the present invention is not restricted to the illustrated embodiment but may be modified as needed to, for example, the forms described below.

In the illustrated embodiment, the present invention is used when the vehicle is backed. However, the invention is not restricted to this but may be employed when the vehicle moves forward.

In the illustrated embodiment, the electronic control unit 20 determines that the accelerator has been operated by force greater than or equal to the predetermined value if the depressing force Pac applied to the accelerator pedal is greater than or equal to the predetermined value Pth. However, the vehicle may include a sensor for detecting the operating acceleration by which the accelerator pedal is operated. In this case, when the detected operating acceleration of the accelerator pedal is greater than or equal to a predetermined value, the electronic control unit 20 determines that the accelerator has been operated by force greater than or equal to the predetermined value. Even in this case, the electronic control unit 20 reliably determines that the accelerator has been operated by the force greater than or equal to the predetermined value based on the operating acceleration of the accelerator pedal is greater than or equal to the predetermined value.

In the illustrated embodiment, the accelerator according to the invention is embodied as the accelerator pedal, which is a component depressed by the foot of the driver. However, the accelerator may be a component manipulated by the hand of the driver.

In the illustrated embodiment, operation of the air-conditioner compressor 8 is prohibited when the accelerator is operated by the force greater than or equal to the predetermined value. However, instead of or in addition to this, the electronic control unit 20 may prohibit operation of the alternator 9. Alternatively, operation of other auxiliary devices driven by the engine may be prohibited. The auxiliary devices include, for example, a water pump. Operation of the water pump may be prohibited as long as the engine 2 can be cooled without causing a problem.

In this modification, by prohibiting the operation of the alternator 9, load caused by an auxiliary device in operation, which is the alternator 9 in operation, is prevented from being generated in a direct manner. However, instead of this, the electronic control unit 20 may prohibit generation of load caused by an electric device such as the blower fan 11, the seat heater 12, and the audio device 13, which are operated through power supply from the battery 10. In this case, the power generating request (the required power generating amount) for the alternator 9 is limited by reducing the power consumption of the battery 10. As a result, the load caused by the auxiliary device in operation, which is the alternator 9 in operation, is limited in an indirect manner.

As has been described, load caused by an auxiliary device can be reduced in the engine 2 not only by completely prohibiting operation of the auxiliary device but also by limiting the operation of the auxiliary device in an indirect manner or in a direct manner without prohibiting such operation.

DESCRIPTION OF THE REFERENCE NUMERALS

1 . . . vehicle, 2 . . . internal combustion engine, 3 . . . torque converter, 4 . . . automatic transmission, 5 . . . differential device, 6 . . . axle, 7 . . . drive wheels, 8 . . . air-conditioner compressor, 9 . . . alternator, 10 . . . battery, 11 . . . blower fan, 12 . . . seat heater, 13 . . . audio device, 20 . . . electronic control unit, 31 . . . accelerator operation amount sensor, 32 . . . pressure sensor, 33 . . . brake sensor, 34 . . . shift position sensor

The invention claimed is:

1. A control apparatus used in a vehicle that obtains a drive force by transmitting output of an internal combustion engine to a drive wheel and includes an auxiliary device operated by the output of the engine, wherein the control apparatus performs output increasing control to increase the output of the engine when the auxiliary device is in operation compared to when the auxiliary device is not in operation, the control apparatus being adapted to carry out output decreasing control to decrease the output of the engine and restrict operation of the auxiliary device when an accelerator operating force is greater than or equal to a predetermined value and the auxiliary device is in operation or when an accelerator operating acceleration is greater than or equal to a predetermined value and the auxiliary device is in operation, wherein the restrict operation of the auxiliary device is performed by limiting the output increasing control to increase the output of the engine when the auxiliary device is in operation compared to when the auxiliary device is not in operation.

2. The apparatus according to claim 1 wherein the restriction on operation of the auxiliary device is carried out to prohibit the operation of the auxiliary device.

* * * * *